US008929790B2

(12) United States Patent
Suzuki et al.

(10) Patent No.: US 8,929,790 B2
(45) Date of Patent: Jan. 6, 2015

(54) FUSER UNIT

(71) Applicants: Noboru Suzuki, Komaki (JP); Kei Ishida, Nagoya (JP); Takuji Matsuno, Ichinomiya (JP); Hisashi Tsukawaki, Nagoya (JP); Seiji Hiramatsu, Nagoya (JP)

(72) Inventors: Noboru Suzuki, Komaki (JP); Kei Ishida, Nagoya (JP); Takuji Matsuno, Ichinomiya (JP); Hisashi Tsukawaki, Nagoya (JP); Seiji Hiramatsu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/625,239

(22) Filed: Sep. 24, 2012

(65) Prior Publication Data

US 2013/0136514 A1 May 30, 2013

(30) Foreign Application Priority Data

Nov. 29, 2011 (JP) ..... 2011-260488

(51) Int. Cl.
*G03G 15/20* (2006.01)

(52) U.S. Cl.
CPC ..... *G03G 15/2053* (2013.01); *G03G 15/2007* (2013.01)
USPC ..... 399/329; 399/122; 399/336

(58) Field of Classification Search
CPC ..... G03G 15/2007; G03G 15/2053
USPC ..... 399/122, 329, 336
See application file for complete search history.

(56) References Cited

U.S. PATENT DOCUMENTS

| | | | | |
|---|---|---|---|---|
| 8,515,325 | B2 * | 8/2013 | Miyauchi et al. | 399/329 |
| 2010/0158587 | A1 | 6/2010 | Shin | |
| 2011/0164905 | A1 | 7/2011 | Kondo et al. | |

FOREIGN PATENT DOCUMENTS

| | | | |
|---|---|---|---|
| JP | 2011-095540 | A | 5/2011 |

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A fuser unit, which heat-fixes a developer image transferred on a recording sheet, the fuser unit includes: a cylindrical member having flexibility; a heat generation member that is arranged at an inside of the cylindrical member and generates radiation heat; a nip member that slidingly contacts an inner periphery of the cylindrical member; a first reflection member that extends along the heat generation member to corresponds with at least a range of a heat generation part of the heat generation member; a second reflection member that is arranged, at an outside of the heat generation member, to at least one of end sides of the first reflection member in the longitudinal direction, and a backup member that forms a nip region by nipping the cylindrical member between the nip member and the backup member, wherein the second reflection member is separated from the first reflection member.

10 Claims, 7 Drawing Sheets

170
172
171

200
210
211
212
213
214
231
230
221
240
241
220
222
231
230
170
UPPER
LEFT
FRONT
REAR
RIGHT
LOWER

FUSER UNIT

CROSS-REFERENCE TO RELATED APPLICATION

This application claims priority from Japanese Patent Application No. 2011-260488 filed on Nov. 29, 2011, the entire subject matter of which is incorporated herein by reference.

TECHNICAL FIELD

This disclosure relates to a fuser unit that heat-fixes a developer image transferred on a recording sheet.

BACKGROUND

Currently, a fuser unit is used in an image forming apparatus of an electrophotographic type and includes a cylindrical fixing film, a heater disposed at an inside of the fixing film, a nip plate arranged to slidingly contact an inner surface of the fixing film and a reflection plate reflecting radiation heat generated from the heater toward the nip plate (for example, refer to JP-A-2011-95540). Specifically, the reflection plate integrally has a central reflection part (first reflection member) extending in a longitudinal direction of the heater and both-end reflection parts (second reflection member) arranged at the outer sides of the central reflection part at longitudinal end portions of the central reflection part. The both-end reflection parts are formed with notched portions to avoid electrodes of the heater in order to suppress the electrodes of the heater from contacting the reflection plate and thus being shorted.

SUMMARY

However, according to the above structure where the both-end reflection parts are formed with the notched portions, the notched portions are formed to be large so that the heater is not shorted. Accordingly, the radiation heat is leaked from the notched portions, so that heating efficiency is lowered.

Accordingly, this disclosure provides at least a fuser unit capable of improving reflection efficiency of a second reflection member.

In view of the above, the fuser unit of this disclosure, which heat-fixes a developer image transferred on a recording sheet while moving the recording sheet in a predetermined direction. The fuser unit comprises: a cylindrical member, a heat generation member, a nip member, a first reflection member, a second reflection member and a backup member. The cylindrical member has flexibility. The heat generation member is arranged at an inside of the cylindrical member and generates radiation heat. The nip member slidingly contacts an inner periphery of the cylindrical member. The first reflection member extends along the heat generation member to correspond with at least a range of a heat generation part of the heat generation member in a longitudinal direction thereof and is configured to reflect the radiation heat generated from the heat generation member toward the nip member. The second reflection member is arranged, at an outside of the heat generation member, to at least one of the end sides of the first reflection member in the longitudinal direction thereof. The backup member forms a nip region by nipping the cylindrical member between the nip member and the backup member. And, the second reflection member is separated from the first reflection member.

According to the fuser unit configured as described above, the first reflection member and the second reflection member are separated from each other. Therefore, since it is possible to make the second reflection member large so that it is in close to the heat generation member, the reflection efficiency of the second reflection member is improved.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Hereinafter, illustrative embodiments of this disclosure will be specifically described with reference to the drawings. In the below descriptions, a schematic configuration of a laser printer 1 having a fuser unit 100 according to an illustrative embodiment of this disclosure will be briefly described, and then a specific configuration of the fuser unit 100 will be described.

Also, in the below descriptions, the directions are described on the basis of a user who uses the laser printer 1. That is, the left side of FIG. 1 is referred to as the 'front', the right side is referred to as the 'rear', the front side is referred to as the 'right' and the back side is referred to as the 'left.' Also, the upper-lower direction of FIG. 1 is referred to as the 'upper-lower.'

<Schematic Configuration of Laser Printer>

Figure 1:
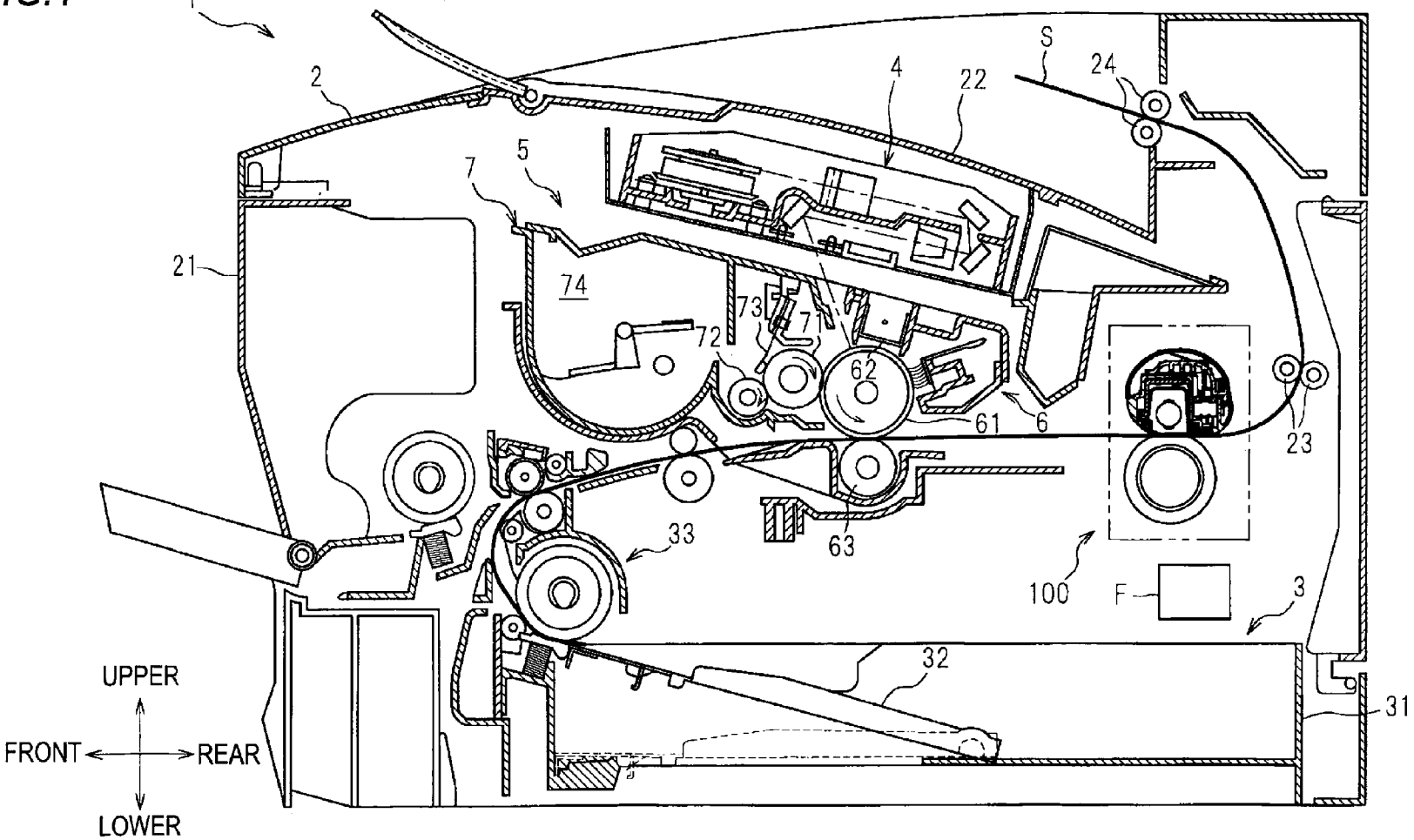
FIG. 1 illustrates a schematic configuration of a laser printer having a fuser unit according to an illustrative embodiment of this disclosure.

As shown in FIG. 1, the laser printer 1 mainly has, in a body housing 2, a feeder unit 3 that feeds a sheet S, which is an example of the recording sheet, an exposure device 4, a process cartridge 5 that transfers a toner image (developer image) on the sheet S and a fuser unit 100 that heat-fixes the toner image on the sheet S. Also, a fan F for exhausting air in the body housing 2 to the outside is provided at a rear part of a left side wall of the body housing 2.

The feeder unit 3 is provided at a lower part in the body housing 2 and mainly has a sheet feeding tray 31, a sheet pressing plate 32 and a sheet feeding mechanism 33. The sheet S accommodated in the sheet feeding tray 31 is upwardly displaced by the sheet pressing plate 32 and is fed toward the process cartridge 5 (between a photosensitive drum 61 and a transfer roller 63) by the sheet feeding mechanism 33.

The exposure device 4 is arranged at an upper part in the body housing 2 and has a laser emitting unit (not shown), a polygon mirror, a lens, a reflector and the like whose reference numerals are omitted. In the exposure device 4, a laser light (refer to the dotted-dashed line) based on image data, which is emitted from the laser emitting unit, is scanned on a surface of the photosensitive drum 61 at high speed, thereby exposing the surface of the photosensitive drum 61.

The process cartridge 5 is disposed below the exposure device 4 and is detachably mounted to the body housing 2 through an opening that is formed when a front cover 21 provided to the body housing 2 is opened. The process cartridge 5 has a drum unit 6 and a developing unit 7.

The drum unit 6 mainly has the photosensitive drum 61, a charger 62 and the transfer roller 63. Also, the developing unit 7 is detachably mounted to the drum unit 6 and mainly has a developing roller 71, a supply roller 72, a layer thickness regulation blade 73 and a toner accommodation unit 74 that accommodates toner (developer).

In the process cartridge 5, the surface of the photosensitive drum 61 is uniformly charged by the charger 62 and then exposed by the high-speed scanning of the laser light emitted from the exposure device 4, so that an electrostatic latent image based on image data is formed on the photosensitive drum 61. Also, the toner in the toner accommodation unit 74 is supplied to the developing roller 71 via the supply roller 72, is introduced between the developing roller 71 and the layer thickness regulation blade 73 and is carried on the developing roller 71 as a thin layer having a predetermined thickness.

The toner carried on the developing roller 71 is supplied from the developing roller 71 to the electrostatic latent image formed on the photosensitive drum 61. Thereby, the electrostatic latent image becomes visible and a toner image is thus formed on the photosensitive drum 61. Then, the sheet S is conveyed between the photosensitive drum 61 and the transfer roller 63, so that the toner image on the photosensitive drum 61 is transferred onto the sheet S.

The fuser unit 100 is arranged at the rear of the process cartridge 5. The toner image (toner) transferred on the sheet S passes through the fuser unit 100, so that the toner image is heat-fixed on the sheet S. The sheet S having the toner image heat-fixed thereon is discharged on a sheet discharge tray 22 by conveyance rollers 23, 24.

<Detailed Configuration of Fuser Unit>

Figure 2:
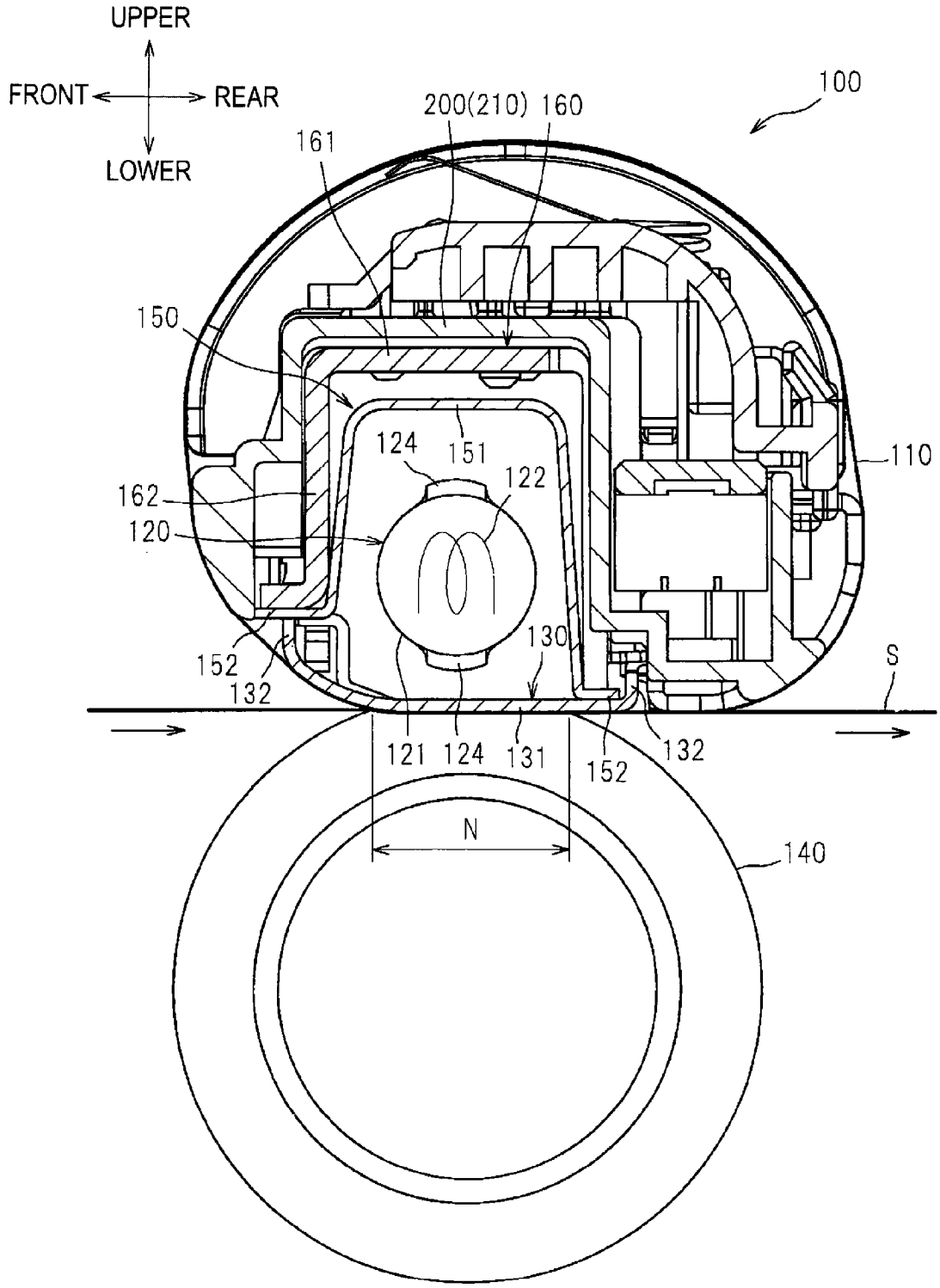
FIG. 2 is a sectional view illustrating the fuser unit.
Figure 3:
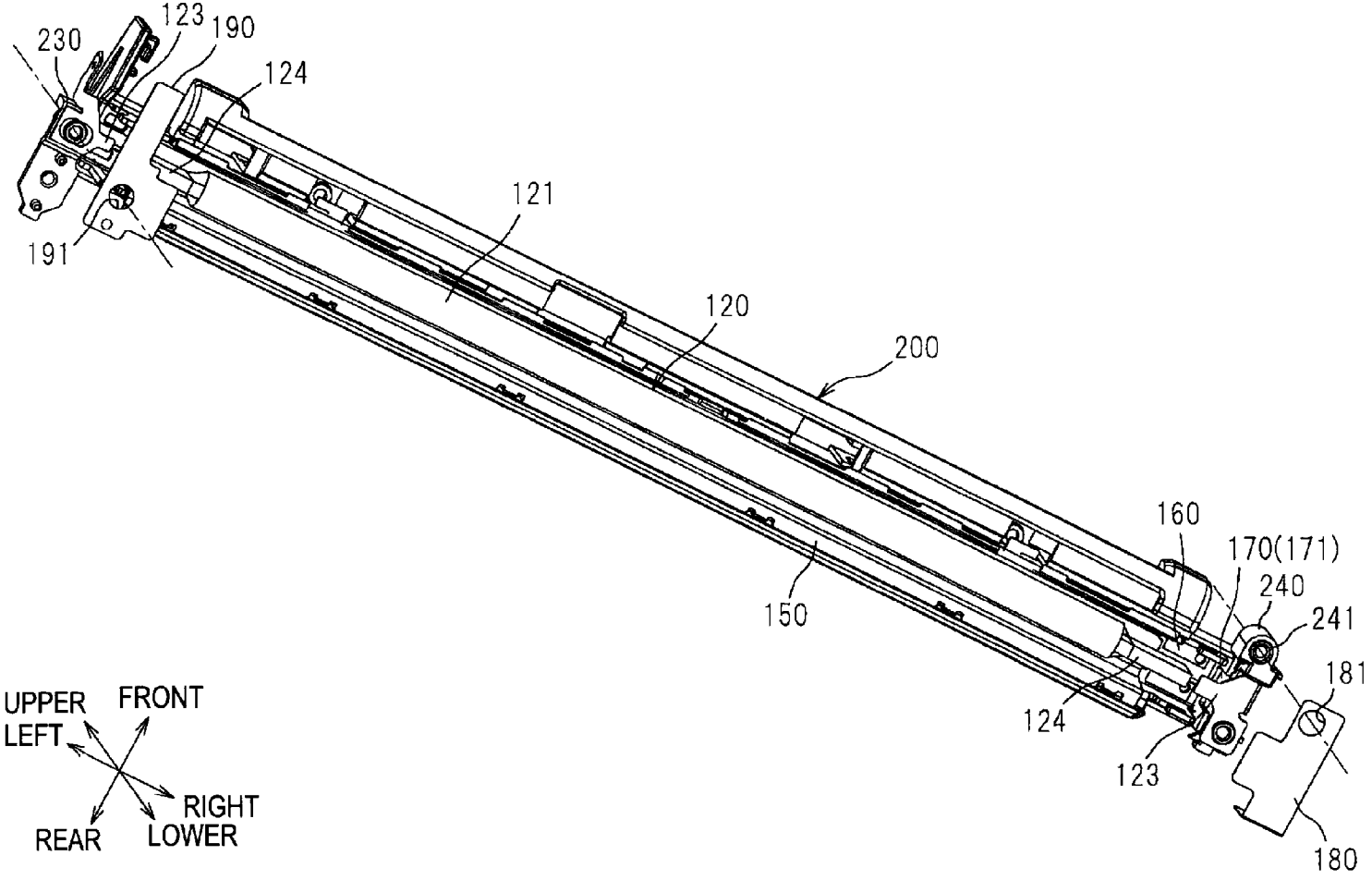
FIG. 3 is a perspective view illustrating a stay, a first reflection plate, a second reflection plate and a halogen lamp assembled to a cover member and a film.

As shown in FIGS. 2 and 3, the fuser unit 100 mainly has a fixing belt 110 that is an example of the cylindrical member, a halogen lamp 120 that is an example of the heat generation member, a nip plate 130 that is an example of the nip member, a pressing roller 140 that is an example of the backup member, a first reflection plate 150, a second reflection plate 170, a stay 160, a cover member 200 and films 180, 190 that are examples of the insulating member.

The fixing belt 110 is a belt of an endless shape (cylindrical shape) having heat resistance and flexibility and rotation thereof is guided by a guide member whose reference numeral is omitted. In this illustrative embodiment, the fixing belt 110 is made of metal, for example stainless steel.

The halogen lamp 120 is a heater that generates radiation heat to thus heat the nip plate 130 and the fixing belt 110, thereby heating the toner on the sheet S. The halogen lamp is arranged at the inside of the fixing belt 110 at a predetermined interval from inner surfaces of the fixing belt 110 and the nip plate 130.

The halogen lamp 120 mainly has a substantially cylindrical glass tube 121 that is elongated in the left-right direction, a filament 122 that is an example of the heat generation part and a pair of electrodes 122 electrically connected to end portions of the filament 122. The halogen lamp 120 is formed by arranging the spirally wound filament 122 in the glass tube 121, closing both end portions of the glass tube 121 and enclosing inert gases including halogen element in the glass tube 121.

The glass tube 121 is provided with sealing parts 124 that are formed when closing both end portions of the glass tube 121, have a substantially flat plate shape extending in a diametrical direction of the glass tube 121, respectively, and protrude from a surface of the glass tube 121 when seen from a longitudinal direction of the glass tube 121. Both the longitudinal end portions of the glass tube 121 are provided with the pair of electrodes 123.

The nip plate 130 is a plate-shaped member to which the radiation heat from the halogen lamp 120 is applied, and is arranged at the inside of the fixing belt 110 so that a lower surface thereof slidingly contacts an inner periphery of the fixing belt 110. In this illustrative embodiment, the nip plate 130 is formed by bending an aluminum plate and the like having thermal conductivity higher than the stay 160 made of steel, which will be described later.

Figure 4:
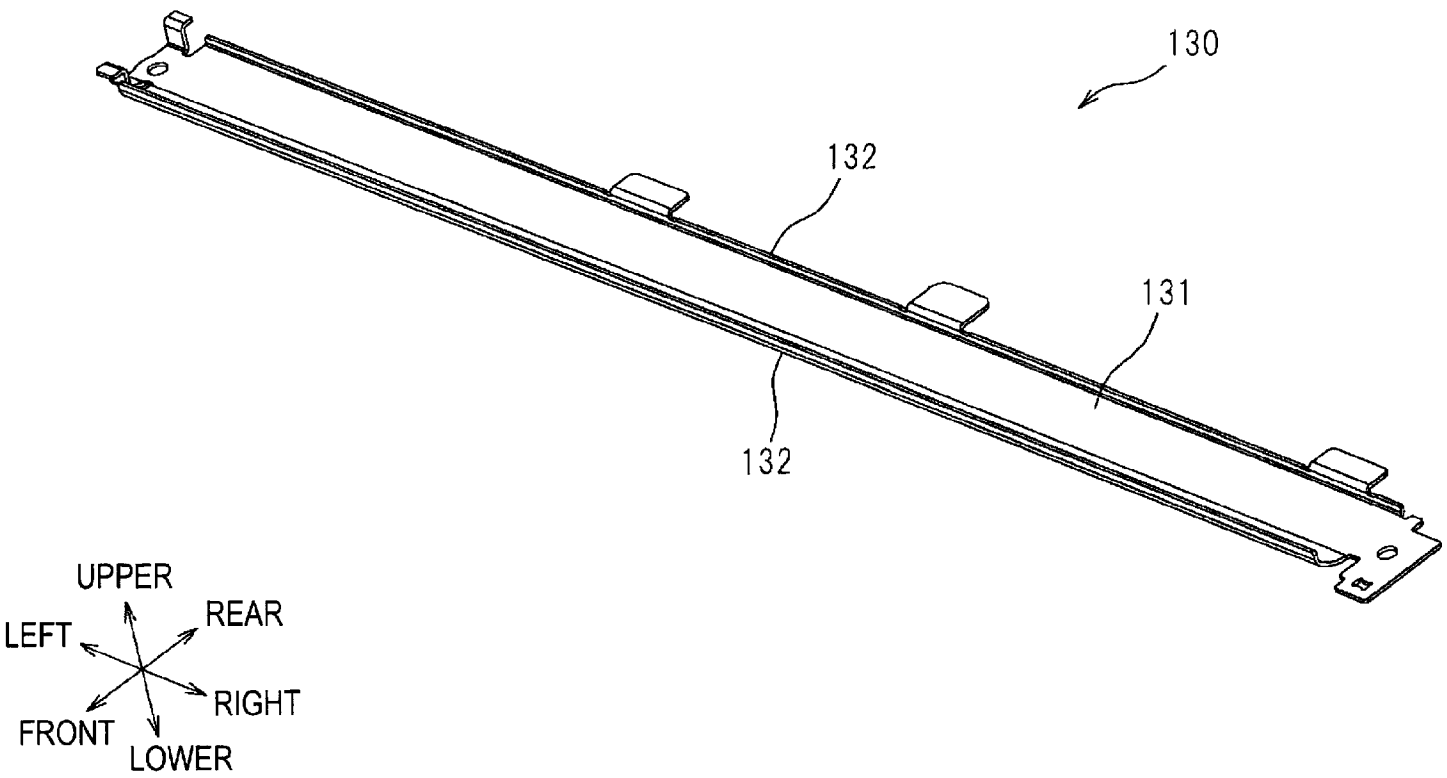
FIG. 4 is a perspective view illustrating a nip plate.

As shown in FIG. 4, the nip plate 130 has a base part 131 and bent parts 132.

The base part 131 is a part that slidingly contacts the inner periphery of the fixing belt 110 at a lower surface thereof and is configured to transfer the heat from the halogen lamp 120 to the toner on the sheet S through the fixing belt 110. The bent parts 132 are formed to extend upward from front and rear ends of the base part 131.

As shown in FIG. 2, the pressing roller 140 is an elastically deformable member and is disposed below the nip plate 130. The pressing roller 140 forms a nip region N by nipping the fixing belt 110 between the nip plate 130 and the pressing roller with being elastically deformable. In this illustrative embodiment, one of the nip plate 130 and the pressing roller 140 is urged toward the other, so that they pressure-contact each other.

The pressing roller 140 is configured to rotate as a driving force is transferred thereto from a motor (not shown) provided in the body housing 2. As the pressing roller rotates, it rotates the fixing belt 110 by a frictional force with the fixing belt 110 (or sheet S). Thereby, the sheet S having the toner image transferred thereto is conveyed between the pressing roller 140 and the heated fixing belt 110 in the front-rear direction (the predetermined direction), so that the toner image (toner) is heat-fixed.

The first reflection plate 150 is a member that reflects the radiation heat (mainly, radiation heat radiated in the front-rear or upper-lower direction) from the halogen lamp 120 toward the nip plate 130 (upper surface of the nip plate 130). The first reflection plate 150 is arranged at a predetermined interval from the halogen lamp 120 so that the first reflection plate 150 covers the halogen lamp 120.

The radiation heat from the halogen lamp 120 is gathered to the nip plate 130 by the first reflection plate 150, so that the radiation heat from the halogen lamp 120 can be efficiently used, and the nip plate 130 and the fixing belt 110 can be rapidly heated.

Figure 5:
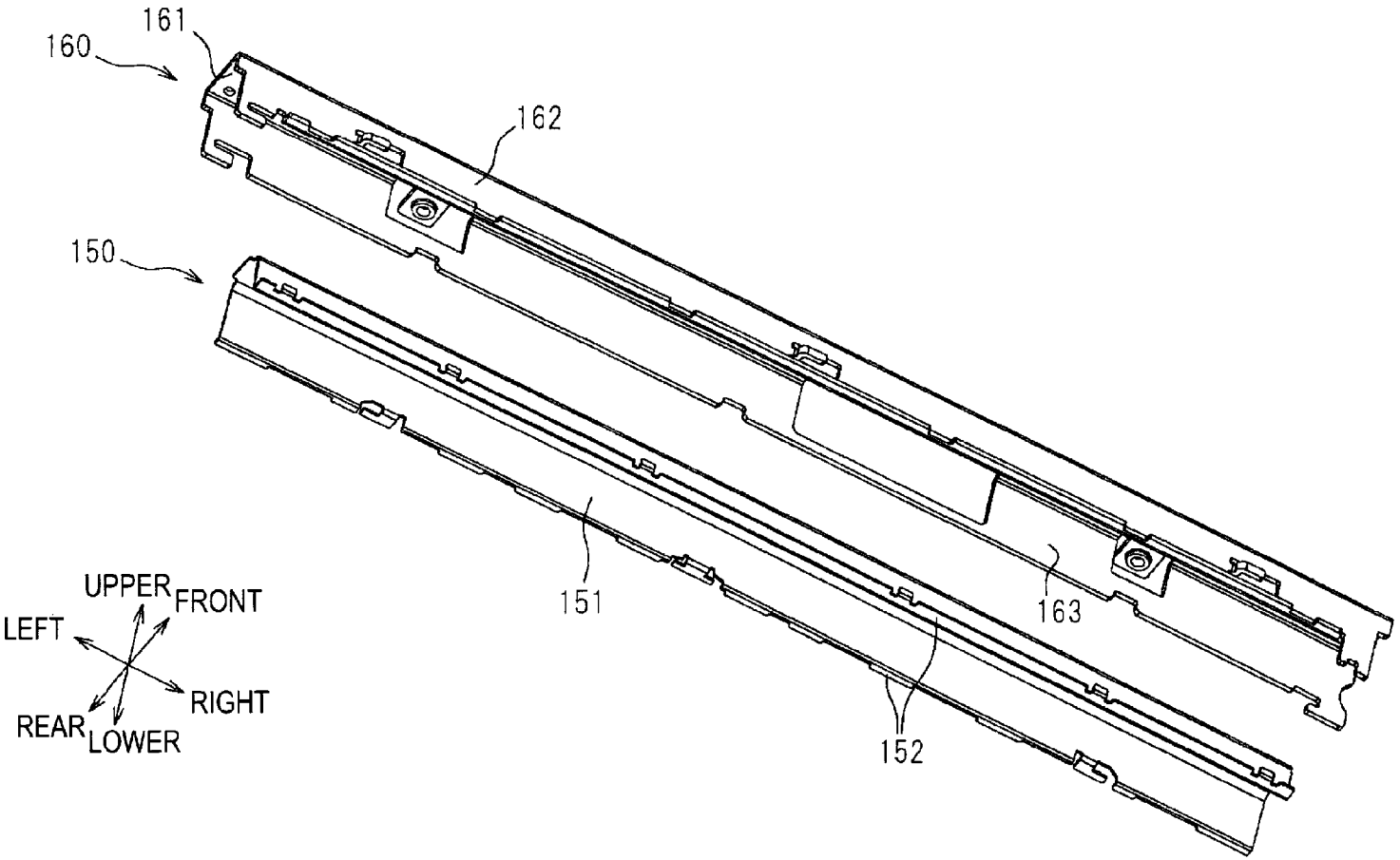
FIG. 5 is a perspective view illustrating the first reflection plate and the stay.

Specifically, the first reflection plate 150 is formed by bending a metal plate, such as aluminum plate and the like having high reflectance of the infrared and far-infrared, into a substantial U shape. More specifically, as shown in FIG. 5, the first reflection plate 150 mainly has a first reflection part 151 having a bent shape (substantial U shape as viewed from a sectional view) and flange parts 152 extending from both end portions of the first reflection part 151 facing the nip plate 130 toward the outside in the front-rear direction. As shown in FIG. 3, the first reflection plate 150 extends along the halogen lamp 120 within a range corresponding to the glass tube 121 (more specifically, filament 122) in the longitudinal direction of the halogen lamp 120.

The second reflection plate 170 is a member that reflects the radiation heat leaked from a right end of the first reflection plate 150, and suppresses a right end portion of the cover member 200 (which will be described later) from being excessively heated due to the radiation heat leaked from the right end of the first reflection plate 150. Also, since the fan F is provided on the left side wall of the body housing 2, as described above, even if the radiation heat is leaked from a left end of the first reflection plate 150, the cover member 200 is cooled by the fan F and is thus suppressed from being excessively heated.

At the right end side of the first reflection plate 150, the second reflection plate 170 is arranged at an outside of the glass tube 121 (filament 122) of the halogen lamp 120 with being separated from the first reflection plate 150.

Figures 6A, 6B:
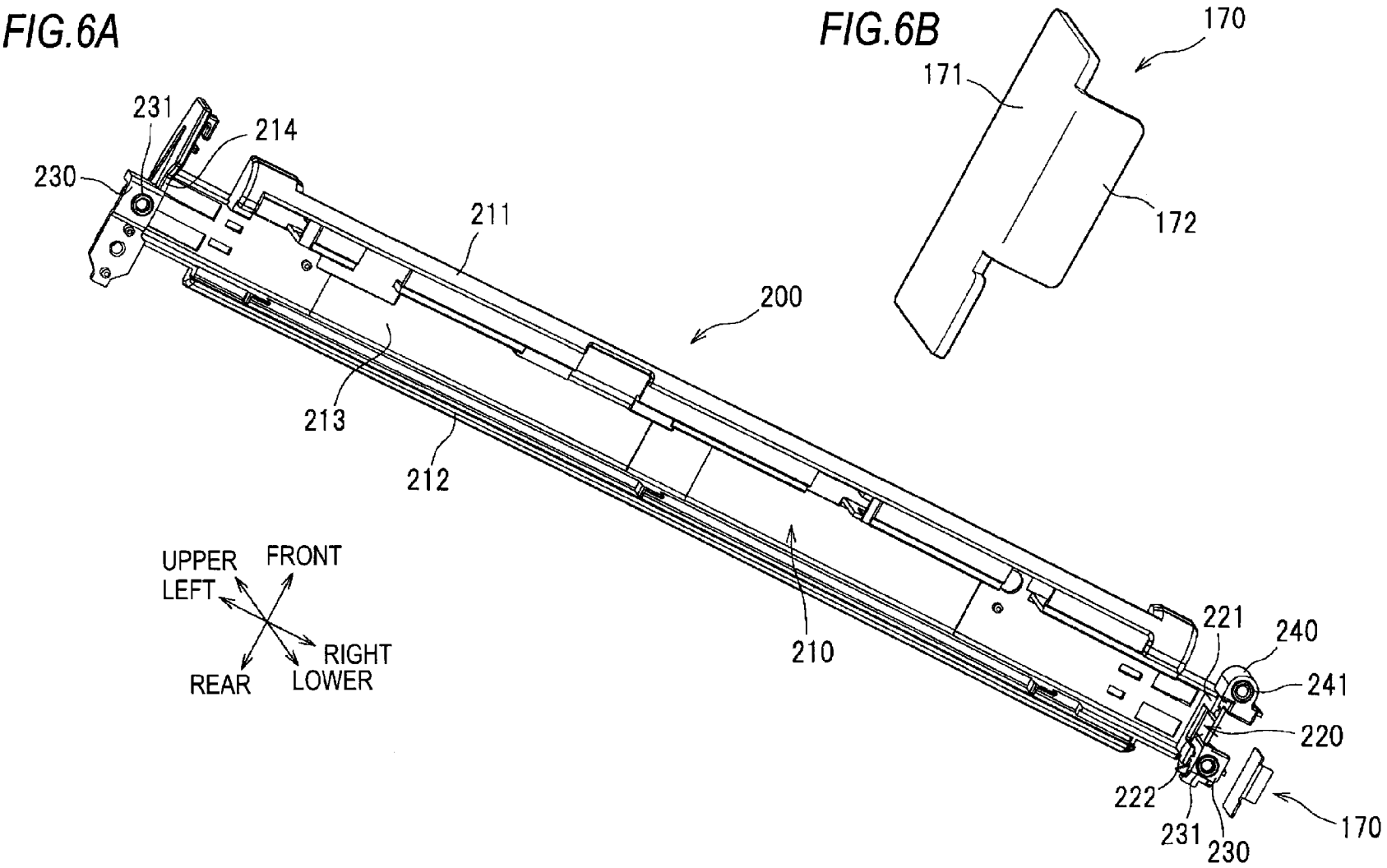
FIG. 6A is a perspective view illustrating the cover member and the second reflection plate and FIG. 6B is an enlarged view illustrating the second reflection plate.

The second reflection plate 170 is made of a metal plate such as aluminum, and has a second reflection part 171 of a plate shape orthogonal to the left-right direction and an extension part 172 extending outward from a lower end of the second reflection part 171 in the left-right direction, as shown in FIGS. 6A and 6B. The second reflection plate 170 is mounted so that the second reflection part 171 faces an internal space of the first reflection plate 150 and the extension part 172 contacts the electrode 123 of the halogen lamp 120.

As shown in FIGS. 2 and 5, the stay 160 is a member that supports the front and rear end portions of the nip plate 130 from an opposite side to the pressing roller 140, and the stay 160 is arranged to cover the halogen lamp 120 and the first reflection plate 150 at the inside of the fixing belt 110. The stay 160 is formed by bending a metal plate, such as steel plate having relatively high rigidity, into a shape having an opening at a side of the nip plate 130 to be along the first reflection plate 150 (first reflection part 151).

More specifically, the stay 160 has an upper wall 161 and a front wall 162 and a rear wall 163 extending downward from front and rear ends of the upper wall part 161. A lower end portion of the front wall 162 supports the front end portion of the nip plate 130 through the front flange part 152 of the first reflection plate 150 from the above and a lower end portion of the rear wall 163 supports the rear end of the nip plate 130 through the rear flange part 152 of the first reflection plate 150 from the above. That is, the first reflection plate 150 is sandwiched between the stay 160 and the nip plate 130.

When force is applied to the nip plate 130 from the below (the pressing roller 140-side), the stay 160 bears the force and supports the nip plate 130.

As shown in FIG. 2, the cover member 200 is a member that is arranged at the inside of the fixing belt 110 and covers the stay 160, and is formed of white insulating resin.

As shown in FIG. 6A, the cover member 200 has a cover part 210 that covers the stay 160 and the like, a second reflection plate accommodating part 220 that holds the second reflection plate 170, electrode support parts 230 that support the electrodes 123 of the halogen lamp 120 and a fixing part 240 to which the film 180 (which will be described later) is fixed.

The cover part 210 has a substantially U-shaped section (refer to FIG. 2) and has the substantially same size as the stay 160 in the left-right direction. The cover part 210 has a front wall 211 and a rear wall 212 facing each other in the front-rear direction and an upper wall 213 connecting upper parts of the front wall 211 and the rear wall 212.

The second reflection plate accommodating part 220 has a pair of wall parts 221, 222 that is formed at the right end portion of the cover part 210 to face each other in the left-right direction, and the second reflection part 171 of the second reflection plate 170 is sandwiched therebetween. Like this, the second reflection plate accommodating part 220 is continuously provided to the cover part 210, so that a gap between the first reflection plate 150 and the second reflection plate 170 separated from each other can be covered by the cover member 200.

Also, the cover member 200 is made of the white resin, so that a surface of the cover member 200 facing the gap between the first reflection plate 150 and the second reflection plate 170 is white and thus it is difficult to absorb the light of the halogen lamp 120 leaked from the gap between the first reflection plate 150 and the second reflection plate 170. Thereby, it is possible to suppress the cover member 200 from being heated due to the light of the halogen lamp 120 leaked from the gap between the first reflection plate 150 and the second reflection plate 170.

Also, the wall part 221 at an inner side in the left-right direction is notched at a central portion, so that the second reflection part 171 of the second reflection plate 170 accommodated in the second reflection plate accommodating part 220 is exposed toward the halogen lamp 120 at an inner side in the left-right direction.

The electrode support parts 230 are provided at left and right ends of the cover part 210 (specifically, at the wall parts 222, 214 protruding downward from both ends of the upper wall 213) and are configured so that lower surfaces thereof contact and support the upper surfaces of the electrodes 123 of the halogen lamp 120. Also, the lower surfaces of the electrode support parts 230 are formed with screw holes 231 into which screws are engaged.

The fixing part 240 is provided at the right end (wall part 222) of the cover part 210 in a line with the electrode support part 230 in the front-rear direction. A lower surface of the fixing part 240 is formed with a screw hole 241 into which a screw is engaged.

As shown in FIG. 3, the films 180, 190 are made of insulating resins and are larger than the electrodes 123 of the halogen lamp 120. The films 180, 190 have holes 181, 191, respectively.

The films 180, 190 are provided to cover the lower surfaces of the electrodes 123 of the halogen lamp 120. Thereby, since the electrodes 123 of the halogen lamp 120 are positioned between the electrode support parts 230 of the cover member 200 and the films 180, 190, it is possible to suppress the discharge from occurring between the fixing belt 110 made of metal and the electrodes 123 of the halogen lamp 120.

In the below, a method of assembling the second reflection plate 170 and the halogen lamp 120 to the cover member 200 is described.

First, the stay 160, to which the first reflection plate 150 has been assembled, is assembled to the cover part 210 of the cover member 200 and the second reflection plate 170 is fitted into the second reflection plate accommodating part 220 so that the second reflection part 171 is interposed between the pair of wall parts 221, 222.

Then, the halogen lamp 120 is arranged at the cover member 200 so that the glass tube 121 is mounted at the inside of the first reflection plate 150 and the electrodes 123 are supported to the electrode support parts 230. At this time, the right electrode 123 is brought into contact with the extension part 172 of the second reflection plate 170. Then, a screw (not shown) is engaged into the screw hole 231 to thus fix the right electrode 123 to the electrode support part 230.

Then, the film 180 is set to overlap with the lower surface of the right electrode 123 of the halogen lamp 120. Then, a screw (not shown) is inserted into the hole 181 and engaged into the screw hole 241 of the fixing part 240, so that the film 180 is fixed to the cover member 200. Also, the film 190 is set to overlap with the lower surface of the left electrode 123 of the halogen lamp 120. Then, a screw (not shown) is inserted into the hole 191 and engaged into the screw hole 231 of the electrode support part 230, so that the film 190 is fixed to the cover member 200 together with the left electrode 123.

According to the above illustrative embodiment, following effects can be obtained.

Since the first reflection plate 150 and the second reflection plate 170 are separated from each other, it is not necessary to suppress the halogen lamp 120 from being shorted by providing the second reflection plate 170 with a large notched part avoiding the electrodes 123 of the halogen lamp 120. Thereby, since it is possible to make the second reflection plate 170 large so that it is in close to the heat generation member, it is possible to provide the second reflection plate 170 with the sufficient surface for reflecting the radiation heat, so that the reflection efficiency of the second reflection plate 170 is improved.

Since the electrodes 123 of the halogen lamp 120 are disposed so that they are in contact with the second reflection plate 170, it is possible to radiate the heat of the electrodes 123 from the second reflection plate 170.

Also, since the electrodes 123 of the halogen lamp 120 are arranged to be interposed between the cover member 200 and the films 180, 190, it is possible to make the fuser unit 100 smaller, compared to a configuration where the electrodes 123 are interposed between the cover member 200 and a thick member.

Although the illustrative embodiment of this disclosure has been described, it should be understood that this disclosure is not limited to the illustrative embodiment. The specific configuration can be appropriately changed without departing from the scope of this disclosure.

In the above illustrative embodiment, the first reflection plate 150 and the second reflection plate 170 are configured as the separate parts. However, this disclosure is not limited thereto. For example, the first reflection plate and the second reflection plate may be configured as one part insomuch as they are separated from each other via air or insulating member.

Figure 7:
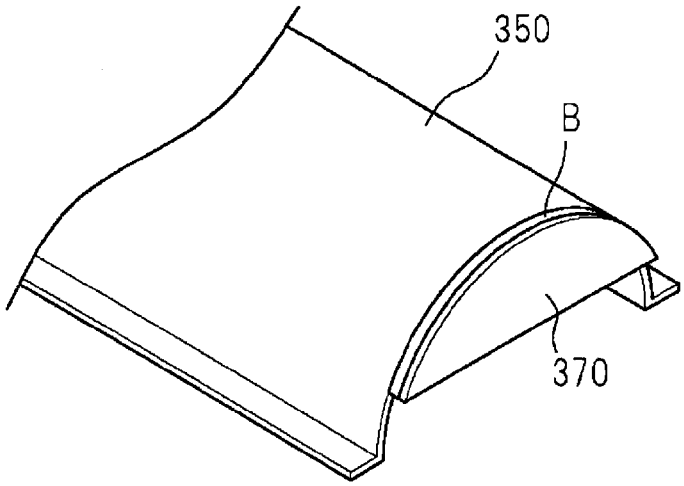
FIG. 7 is a perspective view illustrating a first reflection plate and a second reflection plate according to a first modified embodiment.

For example, as shown in FIG. 7, a first reflection plate 350 and a second reflection plate 370 may be bonded with an insulating adhesive B and thus configured as one part. More specifically, the first reflection plate 350 has a semicircular shape, as viewed from a sectional view. The second reflection plate 370 has a shape covering an upper half part of an end portion of the first reflection plate 350 and is bonded to an end portion surface of the first reflection plate 350 by the adhesive B.

Since the first reflection plate 350 and the second reflection plate 370 are separated from each other with the insulating adhesive B being interposed therebetween, it is possible to achieve the same effects as the above illustrative embodiment.

Figure 8:
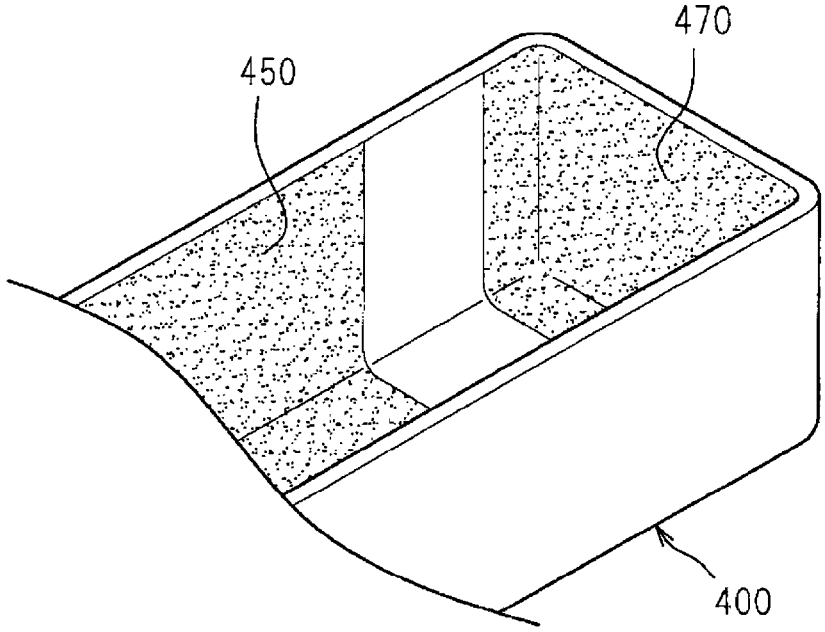
FIG. 8 is a perspective view illustrating a first reflection plate and a second reflection plate according to a second modified embodiment.

Meanwhile, as shown in FIG. 8, a first reflection plate 450 and a second reflection plate 470 may be formed on an inner surface of a box-shaped reflection member 400 with being separated from each other and thus configured as one part.

Specifically, the long box-shaped reflection member 400 is formed of insulating white resin, for example. On the inner surface of the reflection member 400, a longitudinal end portion thereof is configured as the second reflection plate 470 and a portion, which is inwardly separated from the second reflection plate 470 by a predetermined distance, is configured as the first reflection plate 450.

The first reflection plate 450 and the second reflection plate 470 can be formed on the inner surface of the reflection member 400 by vapor deposition of metal such as aluminum with a part of the inner surface near the longitudinal end portion of the box-shaped reflection member 400 being masked.

In the above illustrative embodiment, the second reflection plate 170 is provided only at the right end side (one end side) of the first reflection plate 150. However, this disclosure is not limited thereto. For example, the second reflection plate 170 may be provided at both end sides of the first reflection plate 150.

In the above illustrative embodiment, the electrode 123 of the halogen lamp 120 contacts the second reflection plate 170. However, this disclosure is not limited thereto. For example, a surface of the electrode 123 of the halogen lamp 120 facing the second reflection plate 170 may be provided thereon with an insulating film, for example, thereby separating the electrode 123 of the halogen lamp 120 and the second reflection plate 170 from each other.

In the above illustrative embodiment, the cover member 200 is made of white resin. However, this disclosure is not limited thereto. For example, the cover member 200 may be formed with a material having a color other than white and a surface facing the gap between the first reflection plate 150 and the second reflection plate 170 may be painted with white paint.

In the above illustrative embodiment, the halogen lamp 120 has been exemplified as the heat generation member. However, this disclosure is not limited thereto. For example, a carbon heater may be also used.

In the above illustrative embodiment, the plate-shaped nip plate 130 has been exemplified as the nip member. However, this disclosure is not limited thereto. For example, a thick member other than the plate shape may be also adopted.

In the above illustrative embodiment, the pressing roller 140 has been exemplified as the backup member. However, this disclosure is not limited thereto. For example, a belt-type pressing member may be also used.

In the above illustrative embodiment, the sheet S such as normal sheet and postcard has been exemplified as the recording sheet. However, this disclosure is not limited thereto. For example, an OHP sheet and the like may be also used.

What is claimed is:

1. A fuser comprising:

a cylindrical member having flexibility;

a heater extending through an internal space of the cylindrical member;

a nip member configured to be in contact with an inner peripheral surface of the cylindrical member;

a first reflection member that extends along the heater, and has a surface that faces the heater and forms an internal space; and a second reflection member that faces the internal space of the first reflection member in an axial direction of the cylindrical member, wherein the second reflection member is separated from the first reflection member.

2. The fuser according to claim 1, further comprising an insulating cover member that covers a gap between the first reflection member and the second reflection member, wherein at least a surface of the cover member, which faces the gap, is white.

3. The fuser according to claim 2, further comprising
an insulating member having a film shape,
wherein the cylindrical member is made of metal,
wherein the heater has an electrode at a longitudinal end portion thereof, and
wherein the electrode is sandwiched between the cover member and the insulating member.

4. The fuser according to claim 3, wherein the second reflection member contacts the electrode.

5. The fuser according to claim 1, wherein the heater has a glass tube, the second reflection member facing the glass tube in the axial direction.

6. The fuser according to claim 1, wherein the heater comprises a halogen lamp.

7. The fuser according to claim 1, wherein the second reflection member comprises a metal plate.

8. The fuser according to claim 7, wherein the second reflection member contacts a portion of the heater.

9. The fuser according to claim 8, wherein the second reflection member contacts an end portion of the heater.

10. The fuser according to claim 9, wherein the end portion of the heater includes an electrode of the heater.

* * * * *